United States Patent [19]

Blanchard

[11] 4,168,921

[45] Sep. 25, 1979

[54] CABLE CONNECTOR OR TERMINATOR

[75] Inventor: Clayton H. Blanchard, Horseheads, N.Y.

[73] Assignee: LRC Electronics, Inc., Horseheads, N.Y.

[21] Appl. No.: 619,792

[22] Filed: Oct. 6, 1975

[51] Int. Cl.[2] ..... H01R 13/54

[52] U.S. Cl. ..... 403/19; 403/23; 403/24; 403/342; 339/37

[58] Field of Search ..... 403/343, 19, 13, 14, 403/342, 24, 23; 339/37, 82; 81/121 A, 90 D

[56] References Cited

U.S. PATENT DOCUMENTS

| | | | |
|---|---|---|---|
| 1,447,564 | 3/1923 | Norlund et al. | 81/90 D |
| 2,503,364 | 4/1950 | Viets | 81/121 A |
| 2,910,525 | 10/1959 | Frank | 403/343 X |
| 3,040,284 | 6/1962 | Connell | 403/343 X |
| 3,573,702 | 4/1971 | O'Keefe | 339/37 X |
| 3,861,770 | 1/1975 | Horak | 339/37 |

*Primary Examiner*—Andrew V. Kundrat
*Attorney, Agent, or Firm*—Walter S. Zebrowski

[57] ABSTRACT

A cable connector or terminator suitable for coaxial cables, devices including coaxial cable-like fittings, or the like embodying a protective or security shield is disclosed. The connector or terminator includes a protective sleeve-like shield open at one end and disposed about the male and female connector or terminator members in a manner so as to closely surround at least a portion of the members permitting tool engagement access to the tool engagement surfaces of the connector or terminator longitudinally from the one open end.

5 Claims, 6 Drawing Figures

CABLE CONNECTOR OR TERMINATOR

BACKGROUND OF THE INVENTION

Coaxial cable connectors, terminators, or the like generally have a threaded female portion onto which a threaded male portion is threaded. The male portion embodies opposing flat surfaces or has a hexagonical shape to permit tool engagement so as to firmly connect the female portion to the male portion. Such connectors are readily assembled and disassembled through the use of simple tools such as a wrench, pliers or the like.

In certain applications, such for example as television cable installations, it is highly desirable for safety and economic reasons to prevent or at least deter cable or cable associated equipment manipulation by anyone other than the cable installer or repairman. It is also highly desirable to prevent or at least deter manipulation of or attachment of foreign cables or equipment to unused and terminated cables, or equipment and devices having terminated cable-like fittings thereon, by anyone other than the cable installer or repairman.

SUMMARY OF THE INVENTION

It is an object of the present invention to provide an economical cable connector or terminator which is easily assembled and disassembled.

Another object of the present invention is to provide a cable connector or terminator which prevents or deters unauthorized connection or disassembly thereof and overcomes and heretofore noted disadvantages.

Briefly, according to the present invention, a cable connector is provided which includes a threaded female connector member and a threaded male connector member embodying external surface means for tool engagement to permit turning the male connector member and threading the member onto the female connector member. A protective sleeve-like shield open at one end is disposed about the male and female connector members in a manner so as to closely surround at least a portion of the members permitting tool engagement access to the external surface means from the open end only. Accordingly, the male and female connector members can be assembled and disassembled only with a special tool which can fit between the sleeve-like shield and the connector members, and one which includes means for engaging the external surface means on the male connector member.

These and additional objects, features and advantages of the present invention will become apparent to those skilled in the art from the following detailed description and the attached drawing, on which, by way of example, only the preferred embodiments of this invention are illustrated.

DETAILED DESCRIPTION OF THE INVENTION

It is to be noted that the drawings are illustrative and symbolic of the invention, and there is no intention to indicate scale or relative proportions of the elements shown therein.

As used herein the term connector shall incude and mean one male fitting, portion or member and one female fitting, portion or member which permit one cable to be connected to another cable; a male or female fitting, portion or member attached to a device which is connectable to a cooperating female or male fitting, portion or member on the end of a cable or attached to a second device; and a male or female fitting, portion or member attached to a device or end of a cable to which a cooperating female or male terminator is connectable. By the term terminator is meant a device which is attachable to a cooperating male or female fitting, portion or member for the purpose of terminating, as this term is understood in the art, or covering an otherwise unused cooperating male or female member, portion or fitting.

Figure 1:
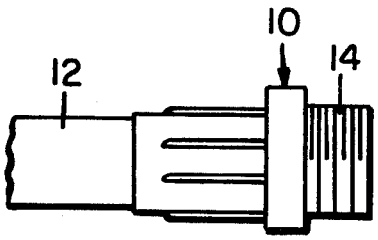
FIG. 1 is an elevational view illustrating a female threaded member of a cable connector.

Referring to FIG. 1, there is shown a threaded female connector fitting, portion or member 10 to which is secured a coaxial cable 12 in a manner well known in the electrical art. Female member 10 includes a male threaded portion 14.

Figure 2:
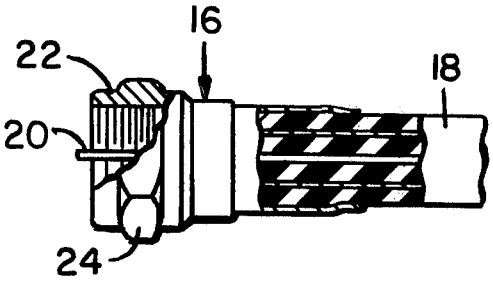
FIG. 2 is an elevational view, partly in section, of a threaded male member of a cable connector.

Referring now additionally to FIG. 2, there is shown a threaded male connector portion or member 16 to which a coaxial cable 18 is attached in a manner well known in the art. The main cable conductor 20 protrudes along the longitudinal axis of the female threaded portion 22 of male member 16. On the exterior surface of female threaded portion 22 are formed a plurality of tool engagement means in the form of one or more opposing pairs of flat surfaces 24. As will be understood, such tool engagement surfaces may be a single pair of opposing flat surfaces or, as is more common, a hexagon may be formed on the exterior surface providing three pairs of opposing flat surfaces 24. As will also be understood, any tool engagement means or surfaces may be formed on female threaded portion 22 of male member 16 within the contemplation of the present invention.

Figure 3:
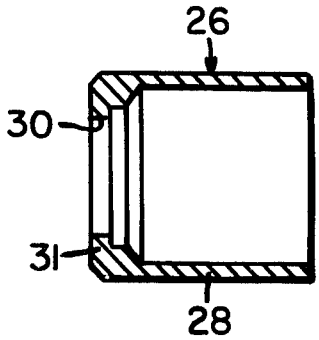
FIG. 3 is a cross sectional view of a protective security shield of the present invention.

Referring to FIG. 3, there is shown a protective sleeve-like shield 26 embodying a tube or sleeve portion 28 open at one end. At the end opposite the open end is formed an aperture 30 along the longitudinal axis of shield 26. Aperture 30 is defined by flange 31 formed at said opposite end.

Figure 4:
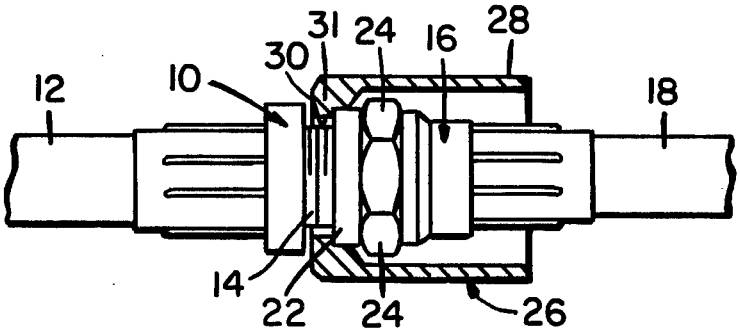
FIG. 4 is an elevational view, partly in section, of one embodiment of the protective cable connector of the present invention.

Referring to FIG. 4, there is shown male threaded portion 14 of the female connector member 10 threaded into female threaded portion 22 of male connector member 16. Protective sleeve-like shield 26 is disposed surrounding at least a portion of the cable connector in a manner such that tube or sleeve portion 28 thereof permits access to tool engagement flat surfaces 24 only from the open end of sleeve portion 28. As illustrated, when the male thread of female connector member 10 is fully threaded into and tightened within female threaded portion 22 of male connector member 16 making full electrical contact between coaxial cables 12 and 18, protective sleeve-like shield 26 is essentially a loose member freely rotatable about the cable connector. In this embodiment flange 31, that is the wall surfaces defining aperture 30, is disposed about male threaded portion 14 of connector member 10. Tube or sleeve portion 28 has sufficient clearance between the inner surface thereof and the exterior tool engagement surfaces 24 to permit a security tool to be inserted therebetween as hereinafter described.

As will be understood, the above described embodiment of protective sleeve-like shield 26 is one which is a separate loose part, however, shield 26 may also be fixedly attached to female connector member 10 or can be rotatably attached to male connector member 16. In the latter embodiment, shield 26 would be a freely rotating part about male connector member 16 and one which is attached thereto by loose crimping or the like.

Figure 5:
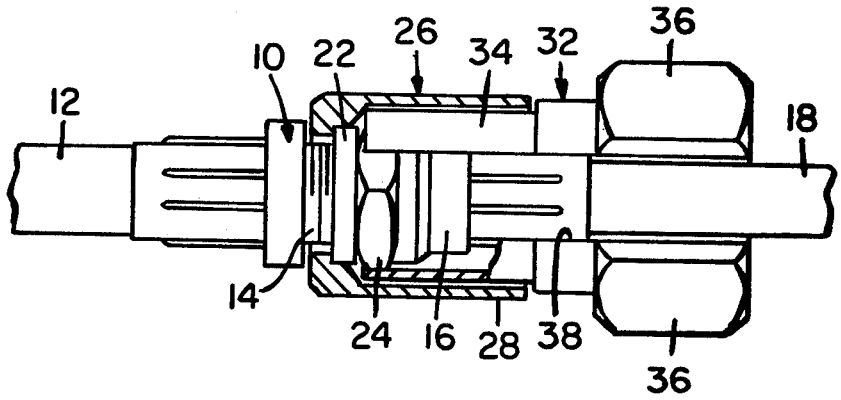
FIG. 5 is the cable connector of FIG. 4 with a cable connector tool in place.

Referring to FIG. 5, there is shown the secured connector of FIG. 4 with a cable connector assembly and disassembly tool 32 disposed about male connector member 16 and coaxial cable 18 in engagement with tool engagement flat surfaces 24. A cable connector tool 32 suitable for the present purposes is described in my copending application entitled "Cable Connector Tool", Ser. No. 619,793, filed on even date herewith, said patent application Ser. No. 619,793 is hereby incorporated by reference and made part hereof. Tool 32 has a hollow tube-like member 34 at one end thereof with means formed at the interior leading edge portion thereof suitable to accommodate the tool engagement flat surfaces 24 of male connector member 16. At the opposite end of tool 32 are formed one or more pairs of opposing flat surfaces 36 to permit a wrench or other tightening tool to be disposed thereabout in a manner well known in the art. Other means for applying mechanical leverage to tool 32 are also described in my copending application Serial No.

Tube-like member 34 is formed to fit relatively loosely within sleeve portion 28 of shield 26 while simultaneously firmly engaging opposing flat surfaces 24 of male connector member 16. As will be understood, an oridinary wrench or the like could not be disposed within shield 26 to permit engagement with flat surfaces 24 due to the close proximity of sleeve portion 28 thereabout. In operation, cable connector tool 32 having a longitudinal cable access aperture 38 is placed over cable 18 away from the cable connector and then permitted to slide down the cable until tube-like member 34 enters the open end of sleeve portion 28 of shield 26 and on into engagement of tube-like member 34 with tool engagement flat surfaces 24. Then by applying mechanical leverage to tool 32 by means of an ordinary wrench or otherwise, tool 32 is caused to rotate and loosen or tighten female threaded portion 22 when disengaging or engaging the cable connector. As will be understood, since shield 26 is either freely rotatable about female threaded portion 22 or affixedly attached to female connector member 10, having a relatively smooth exterior surface, access is prohibited or restricted to tool engagement flat surface 24 of male connector member 16.

Figure 6:
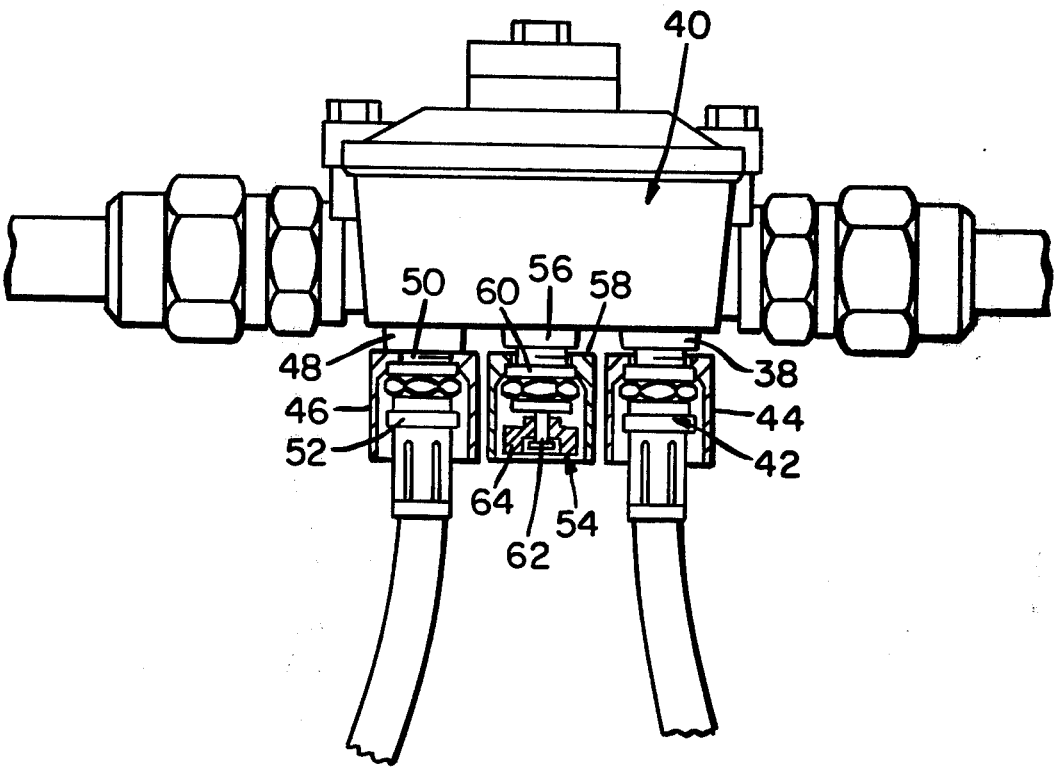
FIG. 6 is an illustration of other embodiments of the protective security cable connector and terminator of the present invention.

Referring additionally to FIG. 6, there is shown another embodiment of the present invention wherein the threaded female connector member 38 is formed as an integral part of a directional tap 40 commonly used in television cable installations. The threaded male connector member 42 is disposed within protective shield 44 and threaded onto the male threaded portion of the female connector member 38 as heretofore described. Similarly, a tool, such as described in connection with FIG. 5 must be employed to gain access to the tool engagement flat surfaces of male threaded connector member 42 in the manner heretofore described.

FIG. 6 also illustrates two other embodiments of the present invention. In one embodiment, protective shield 46 is shown fixedly attached to threaded female connector member 48 which is also illustrated as an integral part of directional tap 40. Shield 46 is fixedly attached to female connector member 48 by threading shield 46 onto the male threaded portion 50 of female member 48 before male connector member 52 is attached as heretofore described.

In the other embodiment of FIG. 6, there is illustrated a male terminator 54 attached to a threaded female connector member 56 within protective shield 58. Member 56 is illustrated as attached to tap 40. Male terminator 54 comprises a female threaded portion 60 such as portion 22 described in connection with FIGS. 2 and 4 hereinabove. However, a terminator rod or cylinder 62 is attached to female threaded portion 60 instead of a cable. If left as such, one might still be able to tamper with or remove the terminator despite protective shield 58 by employing a pair of pliers or the like and turning rod 62 since it is ordinarily fixed to portion 60 and is ordinarily substantially smaller in diameter than the interior diameter of shield 58. Accordingly, a loose fitting, rotatable collar 64 is loosely crimped onto rod 62 rendering any tampering with terminator 54 most difficult, if not impossible, without a cable connector tool 32 as described hereinabove.

Although the present invention has been described with respect to the specific details of certain embodiments thereof, it is not intended that such details be limitations upon the scope of the invention except insofar as set forth in the following claims.

I claim:

1. A cable connector comprising a female connector member having an extended male threaded portion, a male connector member having an internal female threaded portion and embodying external surface means for tool engagement to permit turning said male connector member and threading said member onto said male threaded portion of said female connector member, and a protective sleeve-like shield open at one end disposed about at least a portion of the male connector member and the male threaded portion of said female connector member in a manner so as to closely surround said portions of said members when engaged permitting tool engagement access to said external surface means from said one end, said protective sleeve-like shield being rigidly affixed to said female connector member, said female connector member and said male connector member extending in opposite directions when engaged along the longitudinal axis of said protective sleeve-like shield.

2. The cable connector of claim 1 wherein said protective sleeve-like shield has a female threaded portion at said end opposite said one end adaptable for threading onto the male threaded portion of said female connector member.

3. The cable connector of claim 2 wherein said male connector member is a terminator.

4. The cable connector of claim 3 wherein said terminator comprises a female threaded portion and an extending cylinder attached thereto.

5. The cable connector of claim 4 wherein said terminator further comprises a rotatable collar disposed surrounding said cylinder.

* * * * *